US006116758A

United States Patent [19]

Lin

[11] Patent Number: 6,116,758

[45] Date of Patent: Sep. 12, 2000

[54] LIGHT INLAY FOR VARIOUS HALOGEN LIGHT BULBS, LAGGING ILLUMINATION AND ALL NECESSARY ACCESSORIES

[76] Inventor: Michael Lin, No. 240. Fum Yin Rd., Hsin Chuang, Taiwan

[21] Appl. No.: 09/052,108

[22] Filed: Mar. 31, 1998

[51] Int. Cl.[7] ..... F21V 17/00

[52] U.S. Cl. ..... 362/364; 362/285; 362/365; 362/374

[58] Field of Search ..... 362/147, 364, 362/365, 366, 285, 418, 404, 455, 374

[56] References Cited

U.S. PATENT DOCUMENTS

| | | | |
|---|---|---|---|
| 3,801,815 | 4/1974 | Docimo | 362/364 |
| 4,232,361 | 11/1980 | Kelsall | 362/364 |
| 5,136,489 | 8/1992 | Cheng et al. | 362/294 |
| 5,465,199 | 11/1995 | Bray et al. | 362/365 |
| 5,941,625 | 8/1999 | Morand | 362/365 |

*Primary Examiner*—Y. Quach
*Attorney, Agent, or Firm*—Bacon & Thomas

[57] ABSTRACT

This invention of new down lights is suitable for different halogen bulbs, lagging and all necessary lamp accessories, the main purpose of this new invention is to improve the safety and convenience of installation of old light-inlay, we change the lamp-shell stand to be formed integrated with the tube-shaped part and we design a new mechanism to adjust the height of space for bulb installation, so that our new down lights would be fit well with any different type bulb, even halogen bulbs, furthermore, we could adjust the focus of lamp light in different environment to meet different requirements, and we have a new ring-line placed on the edge of lamp shell stand, the purpose of this new designation is to fit different lagging and accessories in order to provide a more stable and convenient assembly procedure, and the new lamp shell stand with tube-shape part could assure the safety, the new lamp shell stand would never has any opening on it, so that it could keep the high tempered-bulb from dust or any other inflammable materials.

3 Claims, 8 Drawing Sheets

LIGHT INLAY FOR VARIOUS HALOGEN LIGHT BULBS, LAGGING ILLUMINATION AND ALL NECESSARY ACCESSORIES

BACKGROUND OF THE INVENTION

The so called "light-inlay" or "down lights" is like a housing which provides all necessary connects and junctions for lagging,bulbs,accessories, and even the wall and floor; the down lights structure showed in FIG. 1 is designed by "Concord Lighting Limited" in England, this down lights structure is composed of lamp shell stand, light bulb stand, catoptric lagging, lagging, accessories and positioning spring; and the 1. lamp shell stand is mainly composed of annular—shaped shell and an U shaped stand part, the height of space between the U bridge of the device and the annular shell is designed for the installing for the bulb and catoptric lagging,the buckle sets on the ring of annular shell is designed to fit with the button on the lagging, and there is another positioning spring on the bridge which is also designed for assembly purpose, but the down lights structure described above has so many defects obviously limit the application of this product which are as follow:

1. The height of space between the U bridge and the annular shell is fixed and unchangeable, and we must always assembly the bulb under the bridge, so that we could just get only the height to install the lagging and bulb, but the problem is nowadays that one has to cope with many different types of bulbs and lamp holder, for example: JC Bi-pin G6.$^{35}$, MR16 G5.$^{3}$, ES GU10, E10. . . etc, so the conclusion is that the old down lights structure which with the only installation height for bulb is not good enough for different environment, at least there must be some new type down lights which with adjustable installation height for bulb in order to fit different requirements, 2. The height of space between the U bridge and the annular shell is fixed and unchangeable, so we have only one position for bulb,and therefore there is no way to adjust the focus of bulb light.

3. The lamp-shell stand of old down lights showed in FIG. 1 have usually an opening for heat ventilation, in other words, this means the most part of bulb will expose after one finishes the lamp assembly, and it is very dangerous because the bulb will get higher and higher in temperature when in use, the halogen bulbs especially, so the damage would be serious if there is some dirt or inflammable articles which happen to fall on the bulb when the lamp is in use,so the producers must cover a tube-shaped part on the down lights structure to keep safety, but the designation and installation of this tube-shaped part always needs additional work.

SUMMARY OF THE INVENTION

This invention of new down lights is suitable for different halogen bulbs, lagging and all necessary lamp accessories, the main purpose of this new invention is to improve the safety and convenience of installation of old down lights we change the lamp-shell stand to be formed integrated with the tube-shaped part and we design a new mechanism to adjust the height of space for bulb installation, so that our new down lights would be fit well with any different type bulb, even halogen bulbs, furthermore, we could adjust the focus of lamp light in different environment to meet different requirements, and the new lamp shell stand with tube-shape part could assure the safety , the new lamp shell stand would never have any opening on it, so that it could keep the high tempered-bulb from dust or any other inflammable materials , and we have a new ring-line placed on the edge of lamp shell stand,the purpose of this new designation is to fit different lagging and accessories in order to provide a more stable and convenient assembly procedure.

BRIEF DESCRIPTION OF THE DRAWING

1.

2.

3.

4.

5.

6.

7.

8.

9.

DETAILED DESCRIPTION OF THE PREFERRED EMBODIMENT

Figure 1:
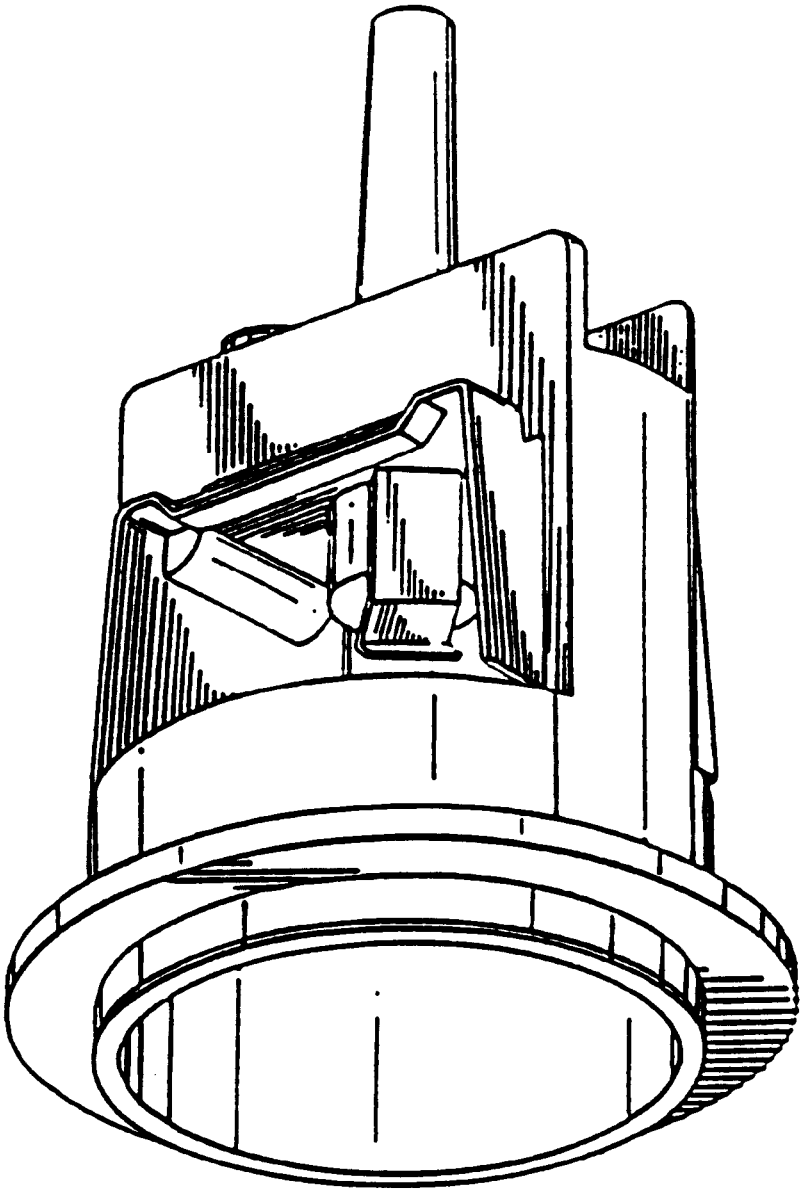
Fig. 1 (PRIOR ART)
FIG 1. The brief drawing of old lamp-inlay structure.

Please refer to the FIG. 2 to FIG. 6 as shown about the example of this inlaid lamp structure first the lamp shell set 2 is designed as close cylinder-shape, forming the empty volume space 20. This gives the close and safety-protected space for assembling, suitable to types of halogen bulb 5 and reflection cover 6 without outstanding shape. The open ends of both sides of lamp shell are named the assembling end 21 and the projecting end 22. There is a pair of connecting plates 211 with holes 212 over the assembling end 21. These consist of an adjustable assembling environment for set 3 up or down and connects with screw. That fits the height and space needed for the chosen halogen bulb 5 in the lamp shell 2. There is a ring edge 23 at the lateral side of the projecting end 22. At least 2 groups of guide slider 231 adjacent to guide opening 232 are made on the ring edge 23. That can screw tight the external cover 7 on the projecting end 22 very easy. It can also change different types of external cover as design or require with its easy taking apart and assembling of the external cover 7, we can choose different cover decoration parts 8 inside the lamp shell 2 of the projecting end 22. There are a lot of dissipating heat holes on the shell of the lamp shell 2 near the assembling end 21. They can properly dissipate the heat produced by the halogen bulb 5. There are some spring holes 25 on the shell around the lamp shell 2 for the set-spring 89. It can be properly assembled by these in different areas or countries.

The adjustable set 3 screwed on the assembling end 21 of lamp shell 2 provides an inside empty space 30 to fix a bulb set 50. This bulb set 50 is chosen according to the type of halogen bulb 5. We can choose different types of bulb sets 50 with relative halogen bulb 5 inside the adjustable set 3. There are at least one pair of guide rail 31 on both outer ends of the adjustable set 3. It has at least one! screw hole 32 on the rail 31 surface. It can be fixed sliding by the one pair of connecting plates 211 over the lamp shell set 2. It can be fixed by matching the screw hole 32 and the connecting hole 212 of connecting plate 211 with a screw after proper height adjustment of the adjustable set 3. At the same time the bulb set 50 can be set up on the assembling end 21 of the lamp shell set 2. We can get the height variations of the bulb set 50 and of the inlaid lamp interior for assembling bulb 5 and reflection cover 6 by the height adjustment of the adjustable set 3. So it is suitable to the assembling of any type of halogen bulb and reflection cover or the focus adjustment of the spot light.

Figure 4:
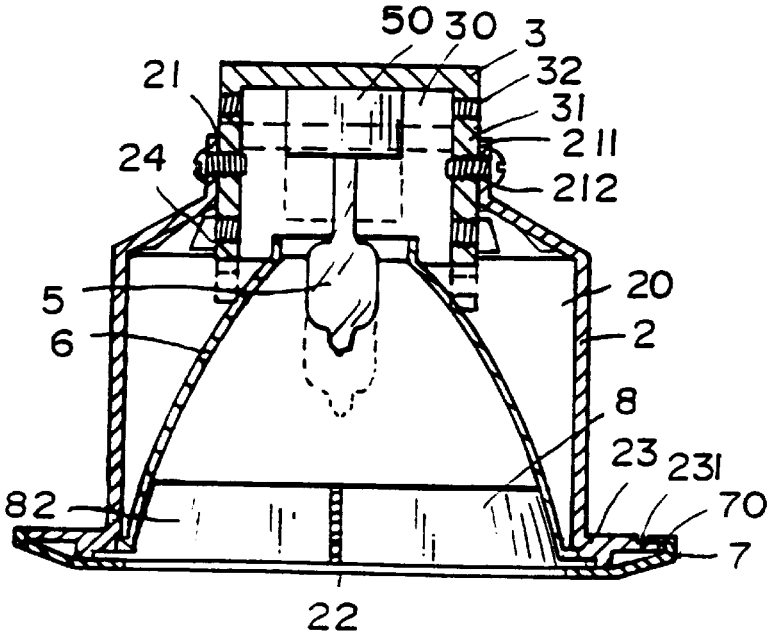
FIG 4. The cutaway view about the assembly of this new lamp-inlay and JC Bi-pin G6.$^{35}$ bulb and the catoptric lagging.
Figure 6:
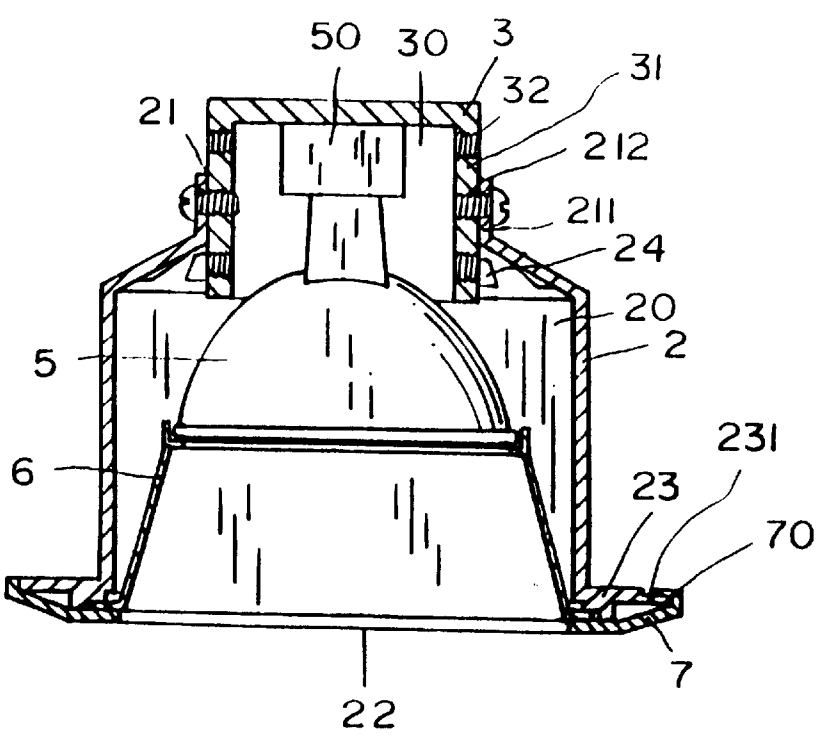
FIG 6. The cutaway view about the assembly of this new lamp-inlay and MR16 G5.$^{3}$ bulb and the catoptric aging.
Figure 5:
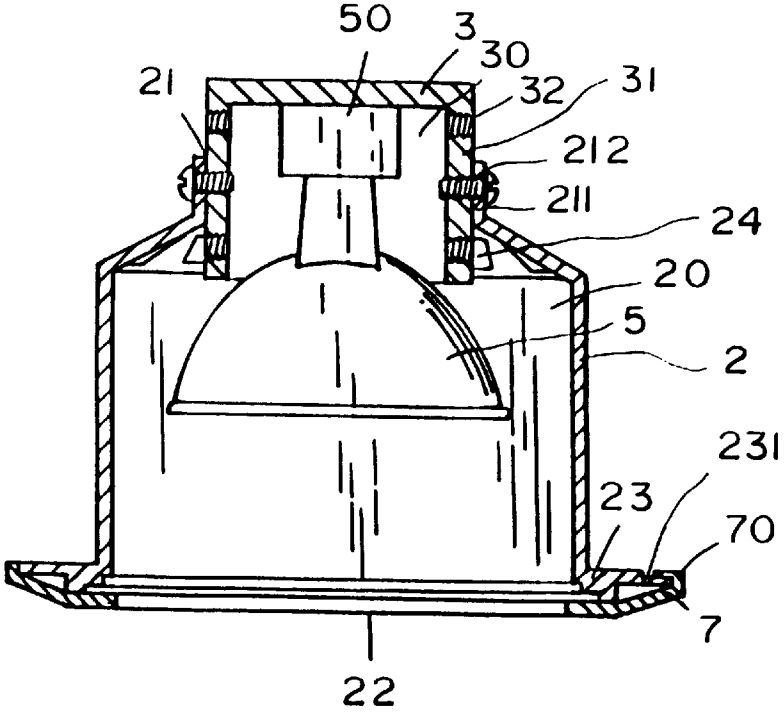
FIG 5. The cutaway view drawing about the assembly of this new lamp-inlay and MR16 G5.$^{3}$ bulb.

The bulb set 50 in this example is for the low voltage type JC Bi-pin $6.^{35}$ and MR16 $G5.^{3}$ 12 V bulb. Refer to FIG. 4 to FIG. 6 for the real assembly. The FIG. 4 is the assembly for the JC Bi-pin $6.^{35}$ type bulb with reflection cover 6. The FIG. 5 is the direct assembly for the type MR16 $G5.^{3}$ without the reflection cover, we can adjust its height by the adjustable set 3. of course, the MR16 $G5.^{3}$ type bulb can be assembled with the reflection cover as FIG. 6.

Figure 2:
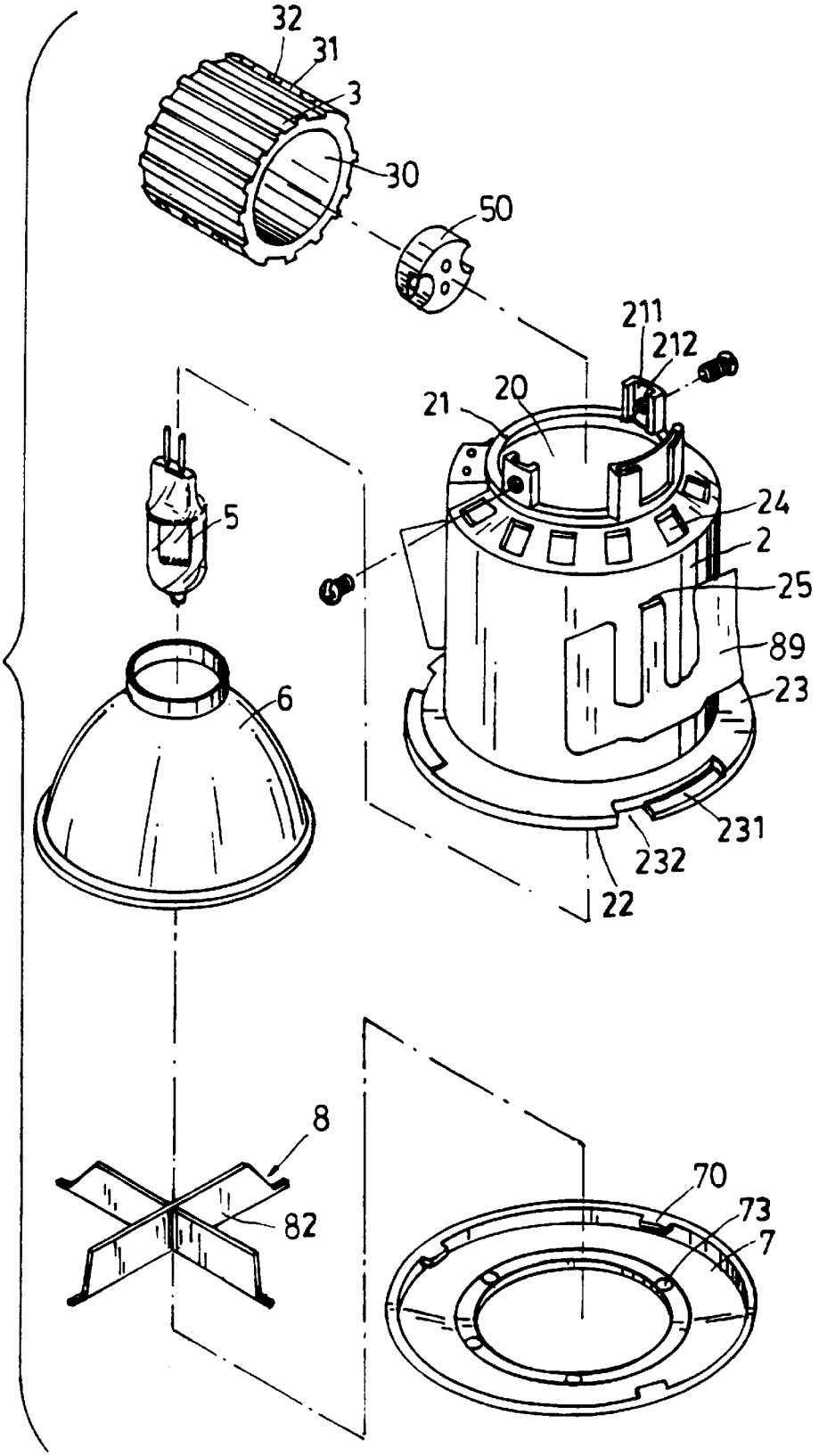
FIG 2. The 3-dimensional detail part drawing of this invention.
Figure 3:
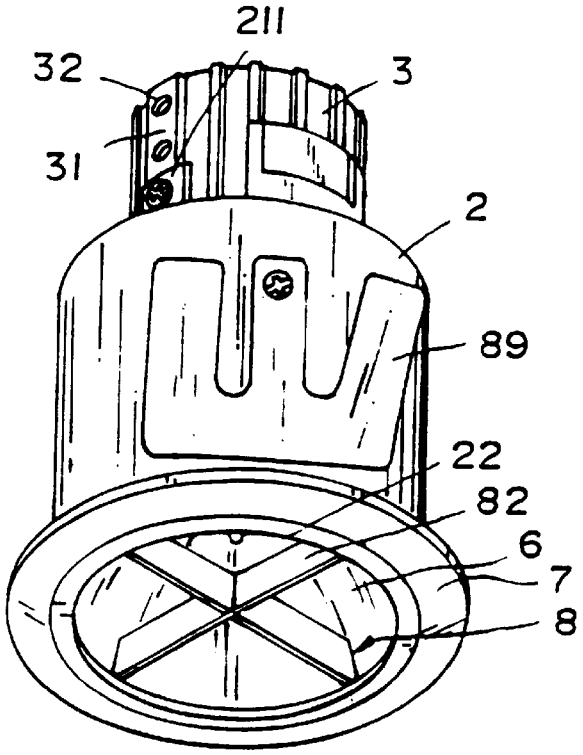
FIG 3. The 3-dimensiconal wholly assembly drawing of this invention.

The external decoration cover 7 of ring edge 23 around the lamp shell set 2 is removable (as FIG.2 and FIG.3). It is a ring-cover parts with an empty end relative to the projecting end 22 of the bulb shell set 2. The external decoration cover 7 can be different kind as design that it can be assembled on the lamp shell set 2 with decoration cover 8. There are at least 2 lock-block 70 on the inner surface of the external decoration cover 7 circumference. This lock-block 70 can be wedged in the guide-opening 232 of ring edge 23 around the lamp shell set 2. It becomes inter-locked by twisting the lock-block 70 into the guide-rail 231 so that the external decoration cover 7 is assembled on the projecting end 22 of the lamp shell set 2. The inner radius on the empty end of external decoration cover 7 is a little larger than the opening radius of the projecting end 22. The difference between this radius makes the stopping function. It supplies an inner space of the lamp shell set 2 or the reflection cover 6 for the decoration cover parts 8 as FIG. 2 and FIG. 3. The decoration cover parts 8 in this example is by encasing a cross decoration 82 directly between the external decoration cover 7 and reflection cover 6. The decoration cover parts 8 and the reflection cover 6 can be taken apart easy after unloading the external decoration cover 7. So it is easy to change the bulb 5. Moreover there can be a lot of holes 73 on the end surface of the external decoration cover 7. The decoration cover parts 8 can be assembled on the external extended pillar. While these holes 73 is for the external extended pillar with the decoration cover parts 8 only. They are not on the external decoration cover 7 normally to keep the outlook fair.

Figure 8:
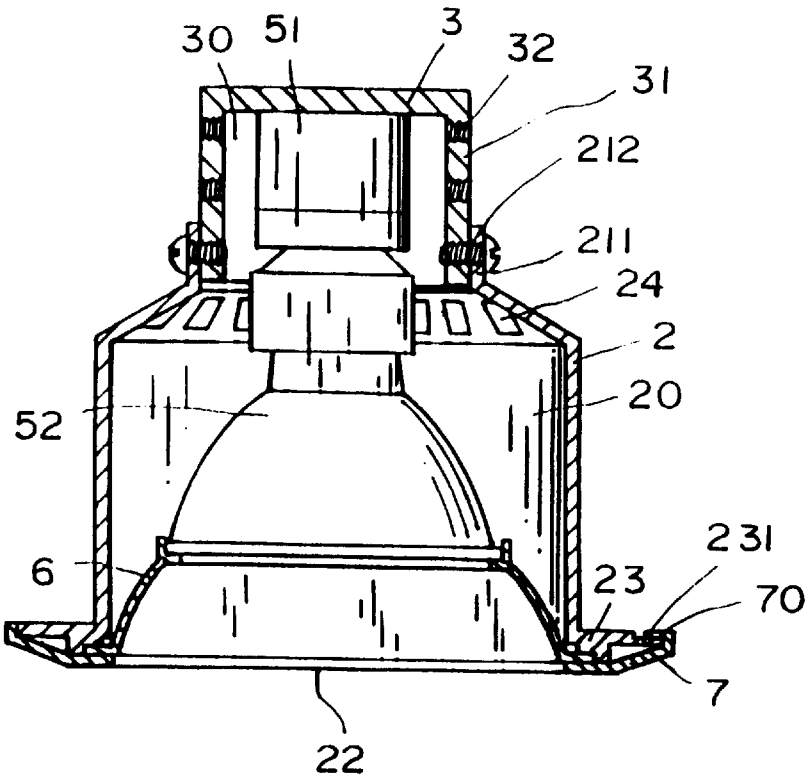
FIG 8. The cutaway view drawing about the assembly of this new lamp-inlay, and E10 halogen bulb.
Figure 7:
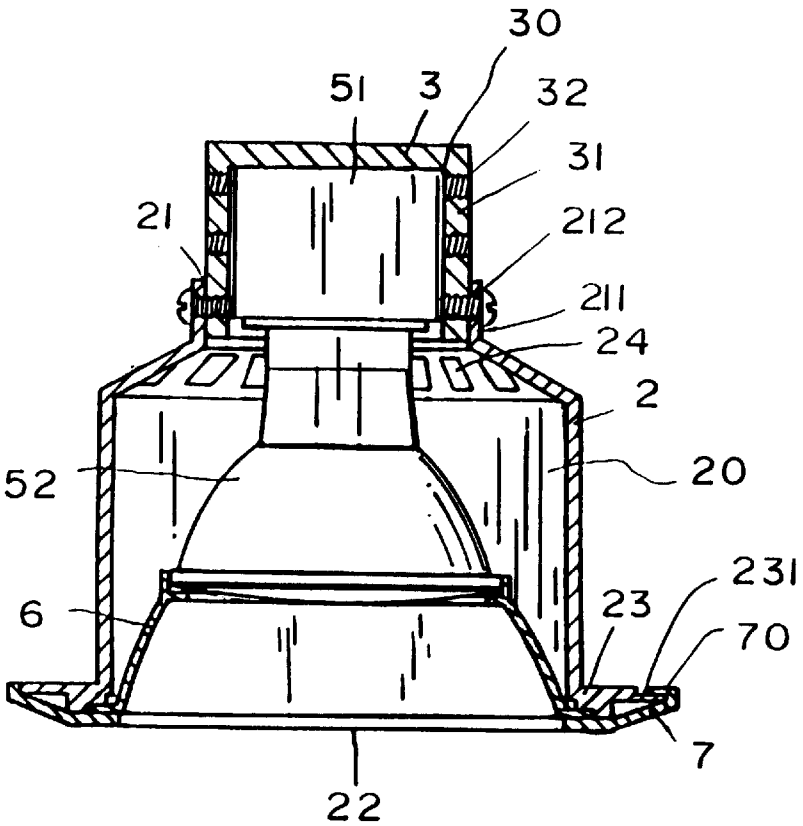
FIG 7. The demonstration drawing about the assembly of this new lamp-inlay and ES GU10 bulb.
Figure 9:
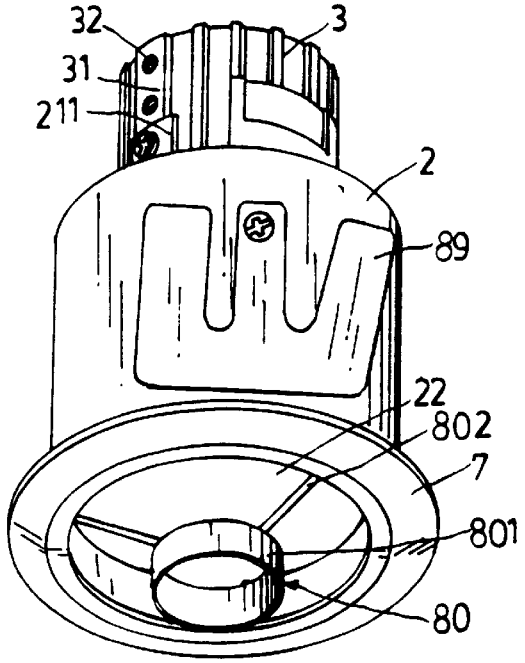
FIG 9.
Figure 10:
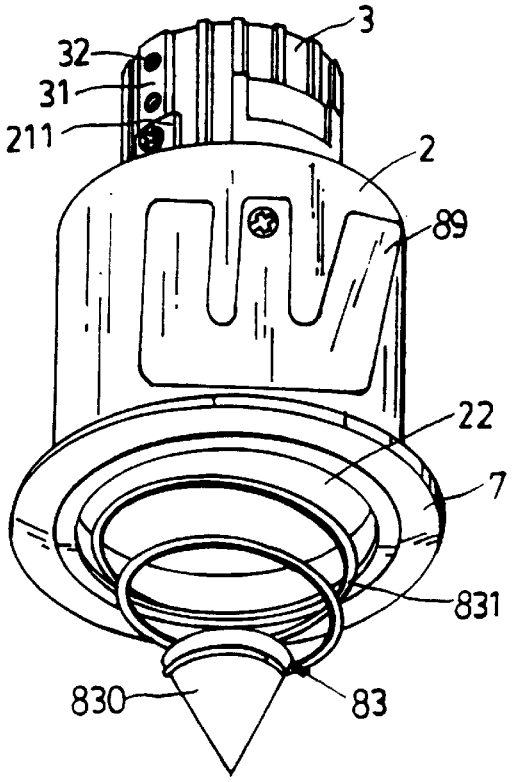
Figure 11:
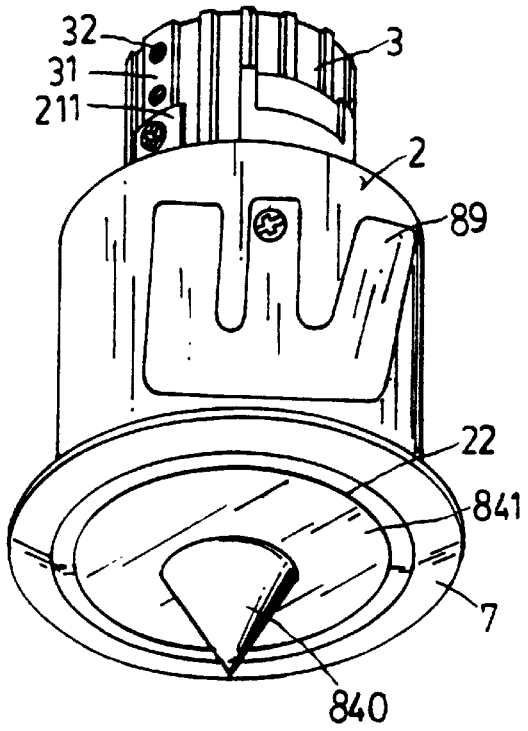

The structure diagrams of this inlaid lamp invention with high voltage (220V–250V ) halogen bulb are as shown in FIG.7 and FIG. 8. The types of assembling end for this high voltage halogen bulb (for examples, ES GU10 and E10) is very different from the low voltage ones. We choose the proper low voltage ones. We choose the proper bulb set 51 fixed in the adjustable set 3, then adjust the fixing height of the adjustable set 3 to match with the longer shape of the high voltage halogen bulb. Such the assembling space in the lamp shell set 2 of the inlaid lamp becomes larger for the high voltage halogen bulb 52. FIG. 9 is the assembly with the type ES GU10 bulb 52. FIG. 10 is the assembly with the type E 10 bulb 53. the assembly with the type E 10 bulb 53. So the same lamp shell set 2 specification can be suitable to any type of halogen bulb with the close-safe assembling function. It improves the formerly bulb assembling length that restricts the bulb type and results in the danger of exposing the bulb, reflection cover.

FIG. 9 to FIG. 14 are the examples different types of decoration cover parts 8 the external decoration cover 7.

Figure 12:
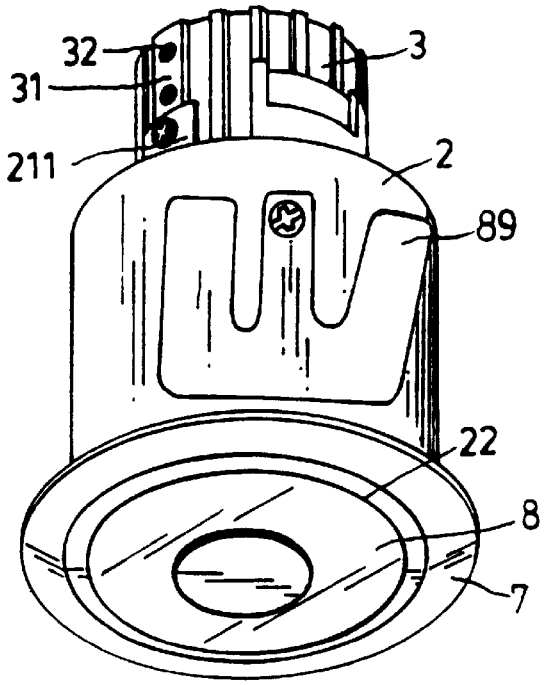
Figure 13:
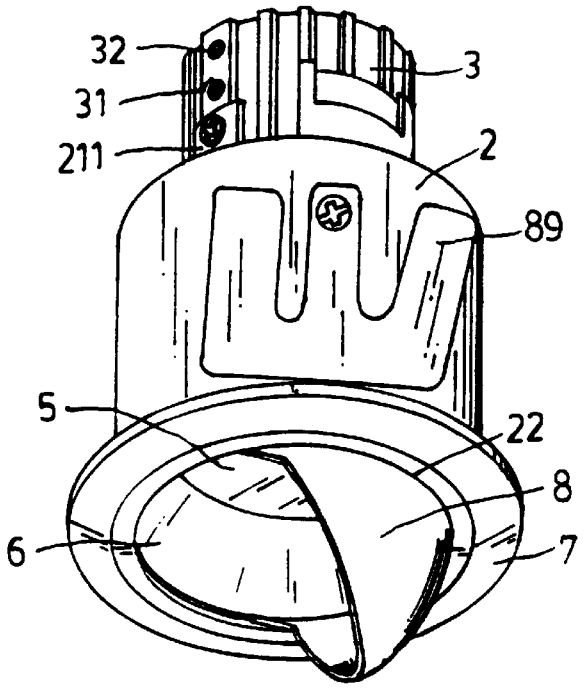
Figure 14:
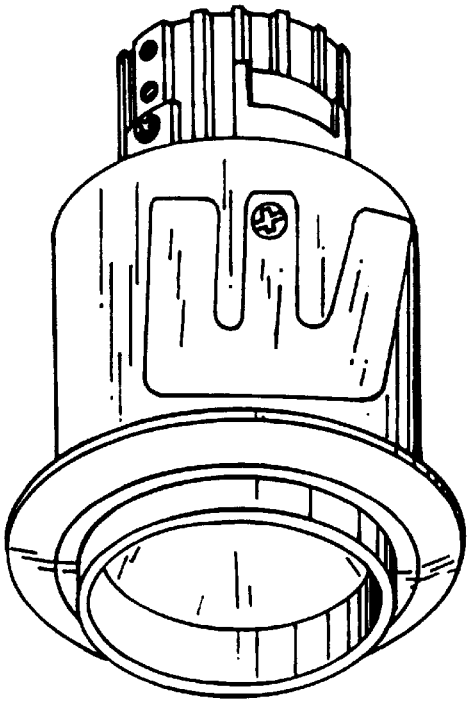
–FIG 14. The demonstration drawing about the assembly of this new lamp-inlay and different type of lagging.

As the example in the FIG. 9, the decoration cover parts 80 consists of a ring 801 with a lot of assembling pillars 802 extending between the external decoration cover 7 and the projecting end 22 of the lamp shell set 2. It can fixed with the screw-lock block of the external decoration cover 7. As the example in the FIG. 10, the decoration cover parts 83 consists of a screwing assembling pillars 831 fixed between the external decoration cover 7 and the projecting end 22. There is a hanging decoration 830 on the extending end of the assembling pillar 831. As the example in the FIG. 11, it consists of a hanging decoration 840 with the glass decoration 841. The FIG. 12 to FIG. 14 are other examples with different types of decoration cover parts, i.e. by the easy unloading of different external decoration cover 7 on ring edge 23 and different decoration cover parts 8, the lamp shell set 2 can be set on the wall or ceiling with different decoration appearance.

What is claimed is:

1. An inlaid lamp structure suitable for any type of halogen bulb and decorative cover parts which comprises a lamp shell set including a surrounding-close cylindrical shaped housing to provide a protected empty space for different types of halogen bulbs, said cylindrical shaped housing having a first and second end; a reflection cover attachable to said second end, said first end of said housing having a radial and inwardly extending flange, said flange having a pair of connecting plates having at least one screw hole and a screw for attaching said flange to a removable assembly including a pair of guide rails having screw holes a removable assembly set in said removable assembly which provides a removable assembly environment with the first end; an adjustable bulb set fixed in said assembly set, the second end of said housing having a radially outwardly extending ring flange containing a screw-locking space by a guide-slider with an adjacent guide opening for connecting to a removable external decorative cover assembly; said decorative cover assembly holding said reflection cover in said housing, said housing containing heat-dissipating holes near said first end and at least one spring-hole for a positioning spring to position said inlaid lamp structure when set.

2. The inlaid lamp structure of claim 1, wherein the bulb set is a halogen bulb set of a high voltage design.

3. The inlaid lamp structure of claim 1, wherein the bulb set is a halogen bulb set of a low voltage design.

* * * * *